US006254083B1

(12) United States Patent
Abe et al.

(10) Patent No.: US 6,254,083 B1
(45) Date of Patent: Jul. 3, 2001

(54) LEAF TRANSFER MECHANISM UNIT

(75) Inventors: Hayami Abe; Yuji Tanaka; Koji Arai, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/540,488

(22) Filed: Mar. 31, 2000

(30) Foreign Application Priority Data

Sep. 30, 1999 (JP) ..... 11-278134

(51) Int. Cl.[7] ..... B65H 3/06; B65H 1/10

(52) U.S. Cl. ..... 271/114; 271/115; 271/125; 271/160

(58) Field of Search ..... 271/114, 115, 271/168, 125

(56) References Cited

U.S. PATENT DOCUMENTS 5,377,969 * 1/1995 Steinhilber ..... 271/21 X
5,419,543 * 5/1995 Nakamura et al. ..... 271/9 X
5,860,645 * 1/1999 Tomura et al. ..... 271/10.13 X
6,056,284 * 5/2000 Shin ..... 271/114

FOREIGN PATENT DOCUMENTS 2-243423 9/1990 (JP) .
5-147749 6/1993 (JP) .
6-100183 4/1994 (JP) .

* cited by examiner

*Primary Examiner*—Christopher P. Ellis
*Assistant Examiner*—Kenneth W Bower
(74) *Attorney, Agent, or Firm*—Armstrong, Westerman, Hattori, McLeland & Naughton, LLP

(57) ABSTRACT

When a driven piece is caused to move forward, a follower piece is allowed to follow the forward movement of the driven piece with the assistance of the biasing force of a biasing member. The follower piece induces the movement of a urging member toward a pickup roller. When the urging member collides against the pickup roller with leaves interposed therebetween, the forward movement of the follower piece is prevented, while the driven piece is still allowed to keep moving forward. The elastic force is stored in the biasing member in response to the forward movement of the driven piece. The urging member is allowed to urge the leaves against the pickup roller by an urging force based on the elastic force stored in the biasing member. When the driven piece is caused to move backward, the follower piece receives the driven piece at the reception surface. The follower piece is allowed to rigidly receive the driving force from the driven piece without any influence of the biasing member. The position of the follower piece is solely determined by the position of the driven piece.

5 Claims, 13 Drawing Sheets

LEAF TRANSFER MECHANISM UNIT

BACKGROUND OF THE INVENTION

1. Field of the Invention

The present invention relates to a leaf management apparatus such as an automatic teller machine (ATM) located in a bank, a convenience store, and the like, for example. In particular, the invention relates to a leaf transfer mechanism unit, in general incorporated in the ATM, comprising a pickup roller, an urging member designed to move toward the pickup roller, and a drive source generating a driving force supplied to the urging member.

2. Description of the Prior Art

In general, a rotative pickup roller is employed in a leaf transfer mechanism unit to transfer bills received in a leaf reception room. The bills should be urged against the pickup roller. When the pickup roller is driven to rotate, the bills can sequentially be transferred one by one. An urging member is designed to move forward toward the pickup roller so as to urge the bills against the pickup roller. The forward movement of the urging member can be achieved by a driving force generated at a drive source such as a servo motor responsive to pulse signals, for example.

If an excessive urging force is applied to a stack of bills on the pickup roller in the leaf transfer mechanism unit, the bills cannot be transferred one by one. In other words, a plurality of bills are simultaneously transferred out of the leaf reception room. On the contrary, if an urging force applied to the bills on the pickup roller is too small, no bills can be transferred out of the leaf reception room. It is difficult to control an urging force applied to the bills on the pickup roller based on a driving force supplied from the aforementioned servo motor.

For example, Japanese Patent Laid-open Nos. 5-147193 and 6-100183 disclose proposals to utilize an elastic spring to transmit a driving force from the drive source to the urging member. The elastic force of the spring serves to optimize the urging force with a relatively simple structure. However, when the spring is interposed between the urging member and the drive source in this manner, a precise control of positioning the urging member can hardly be achieved, since the elastic spring may stretch and shrink in response to the magnitude of load applied to the spring.

SUMMARY OF THE INVENTION

It is accordingly an object of the present invention to provide a leaf transfer mechanism unit capable of precisely controlling the position of an urging member while realizing optimization of the urging force on leaves to be transferred.

According to the present invention, there is provided a leaf transfer mechanism unit comprising: a pickup roller; an urging member designed to move forward toward the pickup roller; a drive source generating a driving force supplied to the urging member; a driven piece designed to move forward and backward along a predetermined direction in response to the driving force; a follower piece connected to the urging member and designed to move forward and backward in the predetermined direction; a biasing member interposed between the driven and follower pieces so as to establish a biasing force for causing the follower piece to follow a forward movement of the driven piece; and a reception surface defined on the follower piece so as to receive a backward movement of the driven piece.

When the driven piece is caused to move forward, the follower piece is allowed to follow the forward movement of the driven piece with the assistance of the biasing force of the biasing member. When the urging member collides against the pickup roller with leaves interposed therebetween, the urging member is restrained from a further forward movement. The forward movement of the follower piece is prevented, while the driven piece is still allowed to keep moving forward. The elastic force is stored in the biasing member in response to the forward movement of the driven piece. The elastic force is then transmitted to the urging member through the follower piece, so that the urging member is allowed to urge the leaves against the pickup roller by an urging force based on the elastic force stored in the biasing member.

When the driven piece is caused to move backward, the follower piece is designed to receive the driven piece at the reception surface. The follower piece is allowed to rigidly receive the driving force from the driven piece without any influence of the biasing member. The position of the follower piece is solely determined by the position of the driven piece. A precise control of positioning the driven piece serves to establish a precise control to the position of the follower piece.

The driven and follower pieces may be integrally formed on a pair of rotors, respectively, allowed for a relative rotation therebetween around a common support axis. The rotors serve to relate the movements of the driven and follower pieces to each other within a smaller occupied space. However, the driven and follower pieces may be integrally formed on a pair of members, respectively, allowed for a relative movement along a common linear path.

The aforementioned pickup roller may comprise: a cylindrical body defining a reception groove extending on an cylindrical periphery in a circumferential direction; a pedestal swelling from a bottom surface of the reception groove; a first and a second elastic piece received in the reception groove at front and rear sides of the pedestal, respectively, in the circumferential direction; an elastic cuticle member covering over the pedestal so as to connect the first and second elastic pieces to each other and designed to constitute the cylindrical periphery of the cylindrical body at an outer surface; a first restriction piece extending from a position adjacent a front end of the first elastic piece in the circumferential direction so as to cover over the first elastic piece and designed to constitute the cylindrical periphery of the cylindrical body at an outer surface; and a second restriction piece extending from a position adjacent a rear end of the second elastic piece in the circumferential direction so as to cover over the second elastic piece and designed to constitute the cylindrical periphery of the cylindrical body at an outer surface.

With the above arrangement, the first and second restriction pieces serve to hold the first and second elastic pieces within the reception groove. On the other hand, when the elastic cuticle member is elastically deformed, the first and second elastic pieces can easily be removed out of the reception groove. The first and second elastic pieces integral to the elastic cuticle member can be replaced with a new one relatively easily. In particular, if the outer surface of the elastic cuticle member is expected to define a friction surface on the pickup roller, it is surely possible to easily exchange the elastic cuticle members which exhibit a lower durability as compared with the cylindrical body. The maintenance of the leaf transfer mechanism unit can be facilitated.

In addition, the pickup roller may further comprise: a first restriction surface defined on the pedestal so as to receive movement of the first elastic piece along the circumferential direction; and a second restriction surface defined on the second restriction piece so as to receive movement of the elastic cuticle member along the circumferential direction. In the case where the outer surface of the elastic cuticle member is expected to define a friction surface on the pickup roller, a reactive force may be exerted on the outer surface of the elastic cuticle member in the circumferential or rotational direction. The reactive force tends to induce movement of the first elastic piece and the elastic cuticle member in the circumferential direction. If such movement can be prevented, the first and second elastic pieces are reliably prevented from dropping out of the reception groove. The first and second elastic pieces as well as the elastic cuticle member are thus reliably prevented from dropping off the cylindrical body.

The foregoing leaf transfer mechanism unit may be incorporated in a leaf management apparatus such as an automatic teller machine (ATM), for example. The leaf may include any of a paper sheet such as a money bill and a valuable ticket, a magnetic card, a plastic card such as a credit card, and the like.

BRIEF DESCRIPTION OF THE DRAWINGS

The above and other objects, features and advantages of the present invention will become apparent from the following description of the preferred embodiment in conjunction with the accompanying drawings, wherein.

DESCRIPTION OF THE PREFERRED EMBODIMENT

Figure 1:
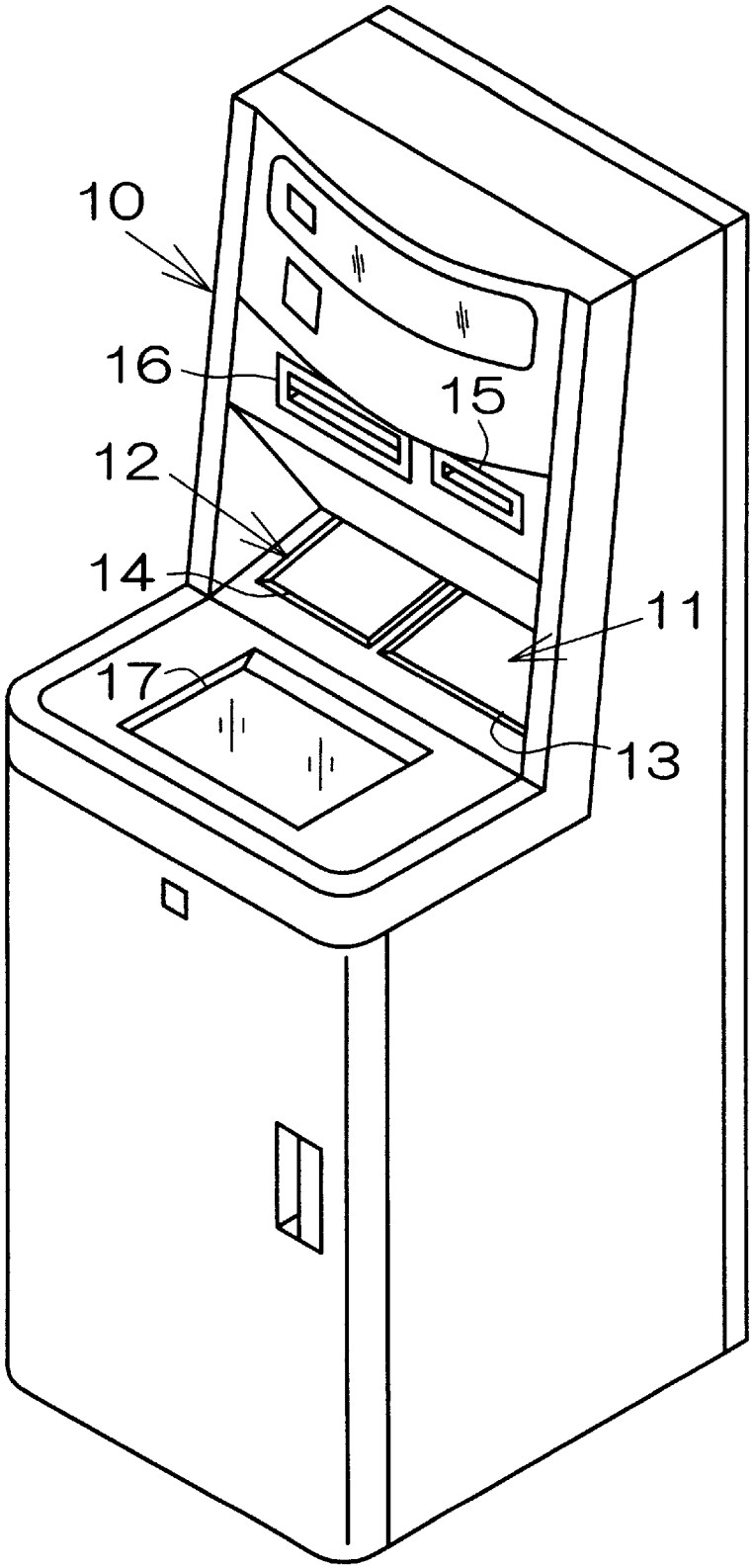
FIG. 1 is a perspective view illustrating an automatic teller machine (ATM)

FIG. 1 illustrates an automatic teller machine (ATM) 10 as a leaf or sheet management apparatus. The operation of the ATM 10 allows a customer to deposit and/or draw cash in and/or from an own account, to pay cash into another account, or the like. When the customer intends to deposit or pay cash, bills can be received in the ATM 10 through a leaf input opening 11 while coins can be received in the ATM 10 through a coin input opening 12. When the customer intends to draw cash, the customer can pick up bills and coins through the leaf input opening 11 and the coin input opening 12, respectively. The bill input opening 11 and the coin input opening 12 can be closed with covers 13, 14, respectively.

In general, a cash card is employed to operate the ATM 10. The cash card can be inserted into the ATM through a card insertion opening 15. In addition, the ATM 10 is designed to make an entry of each item in a bankbook. The bankbook can be inserted into the ATM 10 through a book insertion opening 16.

The ATM 10 includes a so-called touch panel 17. Key buttons for options as well as ten keys and character keys can be displayed on the screen of the touch panel 17. When a customer touches any of the key buttons, the ten keys and the character keys, the ATM 10 is designed to detect or recognize a signal corresponding to the touched key button or key. The operation of these key buttons and keys can be employed to input the sum of cash to be dispensed, a code number of a cash card, or the like, into the ATM 10.

Figure 2:
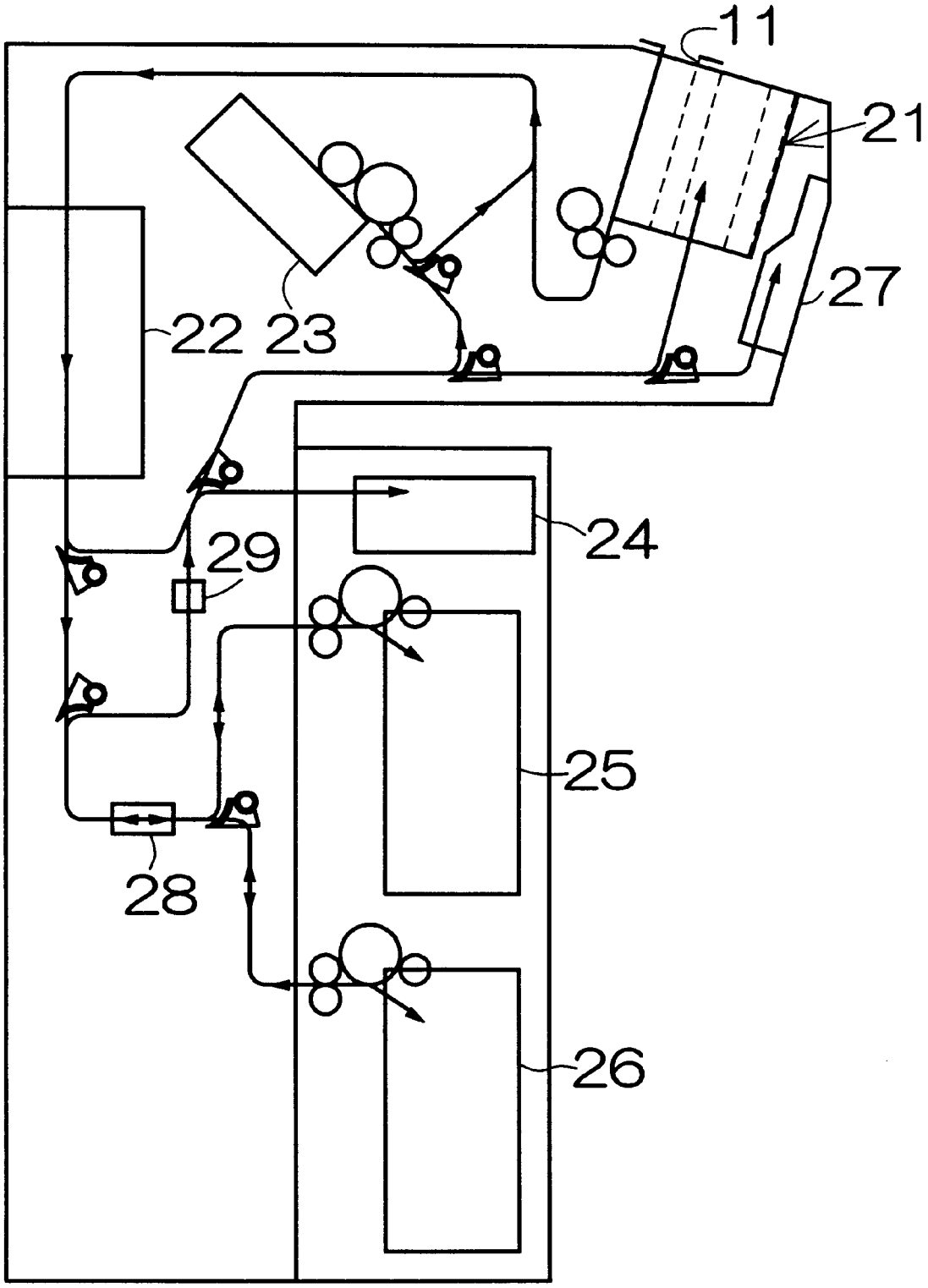
FIG. 2 schematically illustrates paths for transfer of bills within the ATM.

As shown in FIG. 2, a leaf transfer mechanism unit 21 is connected to the leaf input opening 11. When a plurality of or a stack of bills are inserted into the leaf input opening 11, the leaf transfer mechanism unit 21 is designed to sequentially transfer the input bills one by one. The bills are then transferred to a discrimination section 22. The discrimination section 22 is designed to distinguish genuine bills from false bills and other types of leaves and to calculate the total amount of money for the genuine bills.

The genuine bills are transferred to a temporary storage room 23. The remaining leaves, which have been determined unacceptable, are returned to the leaf transfer mechanism unit 21. The remaining leaves may include false bills and other types of leaves such as shopping receipts. A customer is allowed to pick up the leaves, returned to the leaf transfer mechanism unit 21, through the leaf input opening 11. The genuine bills temporarily stored in the temporary storage room 23 can be returned to the leaf transfer mechanism unit 21 through the discrimination section 22 in response to cancellation of the transaction. The customer is allowed to pick up the returned genuine bills out of the leaf transfer mechanism unit 21.

On the other hand, when continuation of the transaction has been confirmed, the genuine bills stored in the temporary storage room 23 is transferred to the discrimination section 22 a second time. This time, the discrimination section 22 serves to distinguish reusable ¥10,000 bills and ¥1,000 bills from the remaining genuine bills such as heavily damaged ¥10,000 and ¥1,000 bills, not suitable to reuse, and the other kinds of genuine bills, including ¥5,000 bills, for example. The remaining genuine bills are retrieved into a storage container 24. The reusable genuine ¥10,000 bills are transferred to a ¥10,000 bill container 25, while the reusable genuine ¥1,000 bills are transferred to a ¥1,000 bill container 26. The customer sometimes carelessly leaves the bills which has been not received in the ATM 10. The bills left in the leaf transfer mechanism unit 21 is transferred to a retrieval container 27 through the discrimination section 22.

When a customer intends to take cash out of the ATM 10, ¥10,000 bills and/or ¥1,000 bills corresponding to the requested amount of money are picked up from the ¥10,000 bill container 25 and/or the ¥1,000 bill container 26. The width and thickness of the bills are then measured and examined at a width sensor 28 and a thickness sensor 29, respectively. The approved bills are thereafter transferred to the leaf transfer mechanism unit 21. The customer is expected to receive a set of ¥10,000 bills and/or ¥1,000 bills corresponding to the requested amount of money out of the leaf input opening 11. The customer sometimes carelessly leaves the bills dispensed in the leaf transfer mechanism unit 21. The bills left in the leaf transfer mechanism unit 21 is transferred to the retrieval container 27 through the discrimination section 22.

Figure 3:
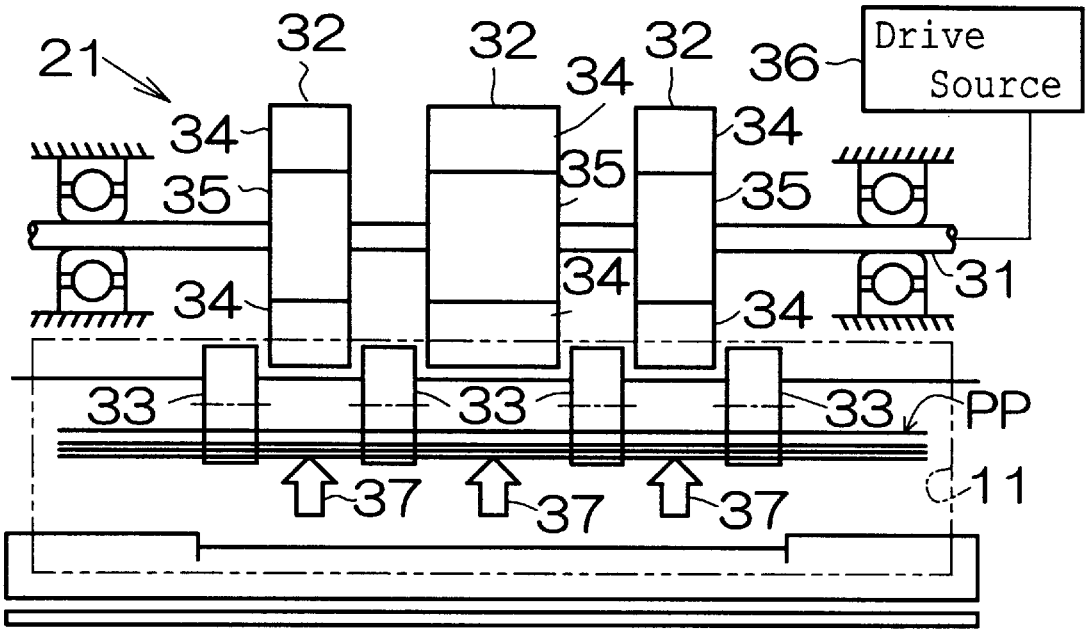
FIG. 3 is an enlarged plan view, observed through a leaf input opening, schematically illustrating a leaf transfer mechanism unit.

Next, the structure of the leaf transfer mechanism unit 21 will be described in detail. As shown in FIG. 3, the leaf transfer mechanism unit 21 comprises, for example, three rotative pickup rollers 32 supported on a rotation axis 31 for rotation, and four separators 33 arranged alternately with the pickup rollers 32 in the longitudinal direction of the rotation axis 31. As is conventionally known, the pickup roller 32 includes a slippery surface 34 defined on the outer cylindrical periphery for allowing the slippage between the pickup roller 32 and a leaf during rotation of the pickup roller 32, and a friction surface 35 likewise defined on the outer cylindrical periphery for generating a larger friction between the pickup roller 32 and a leaf during rotation of the pickup roller 32. A drive source 36 is designed to control the rotation or action of the pickup rollers 32. The drive source 36 may comprise a servo motor responsive to pulse signals, for example. The separator 33 comprises at least a friction surface defined on the outer surface. A rubber roller, prevented from rotation, may be employed as the separator 33, for example.

As is apparent from FIG. 3, a stack of bills PP are urged against the pickup rollers 32 in the radial direction 37 of the pickup rollers 32. When the rotating pickup rollers 32 contact the first or top bill PP at the friction surface 35, the rotation of the pickup rollers 32 is transformed into a movement of the first bill PP between the pickup rollers 32 and the separators 33. The first bill PP is then transferred to subsequent rollers, not shown. The separators 33 are designed to exert a friction on the remaining bills PP, namely, the second and subsequent bills PP. The remaining bills PP cannot pass by the separators 33. When the slippery surface 34 comes to contact the top bill PP of the stack, the rotation of the pickup rollers 32 is terminated. The pickup rollers 32 are designed to repeat such an action or behavior in the aforementioned manner until all of the bills PP in the leaf transfer mechanism unit 21 are taken out.

Figure 4:
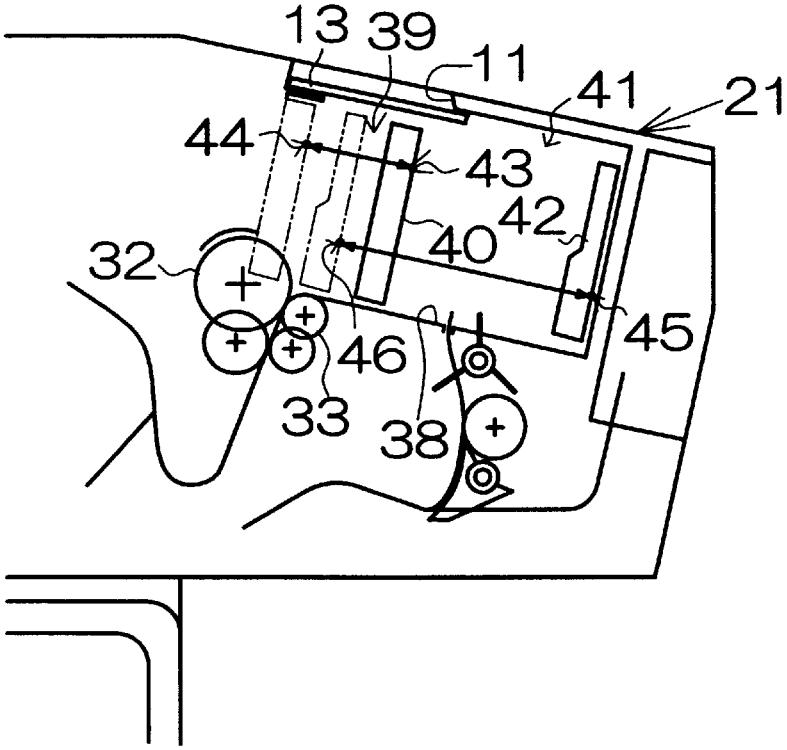
FIG. 4 is an enlarged partial side view of the ATM for schematically illustrating the structure of the leaf transfer mechanism unit.

As shown in FIG. 4, the leaf transfer mechanism unit 21 comprises a slide plane 38 defined by a rigid plate or rigid frames. The slide plane 38 is designed to guide a forward sliding movement of the bills PP toward the pickup rollers 32. The slide plane 38 is tilted up in the forward direction. A partition unit 40 is disposed on or above the slide plane 38. The partition unit 40 is designed to define a leaf reception room 39 between the pickup rollers 32 and itself. Likewise, a retrieval or rear urging member 42 is disposed on or above the slide plane 38. The retrieval urging member 42 may be a rigid plate or frame. The retrieval urging member 42 is designed to define a leaf delivery room 41 between the partition unit or member 40 and itself behind the partition unit 40. The partition unit 40 and the retrieval urging member 42 are maintained in an attitude upright to the slide plane 38. In addition, the partition unit 40 is allowed to move forward and backward along a predetermined path between a rearmost or standard position 43 remotest from the pickup rollers 32 and a front or turnout position 44 where the pickup rollers 32 is exposed in the leaf delivery room 41 behind the partition unit 40. The retrieval urging member 42 is allowed to move forward and backward along a predetermined path between a rear limit position 45 remotest from the partition unit 40 and a front limit position 46 where the retrieval urging member 42 collides against the pickup rollers 32.

Figure 5:
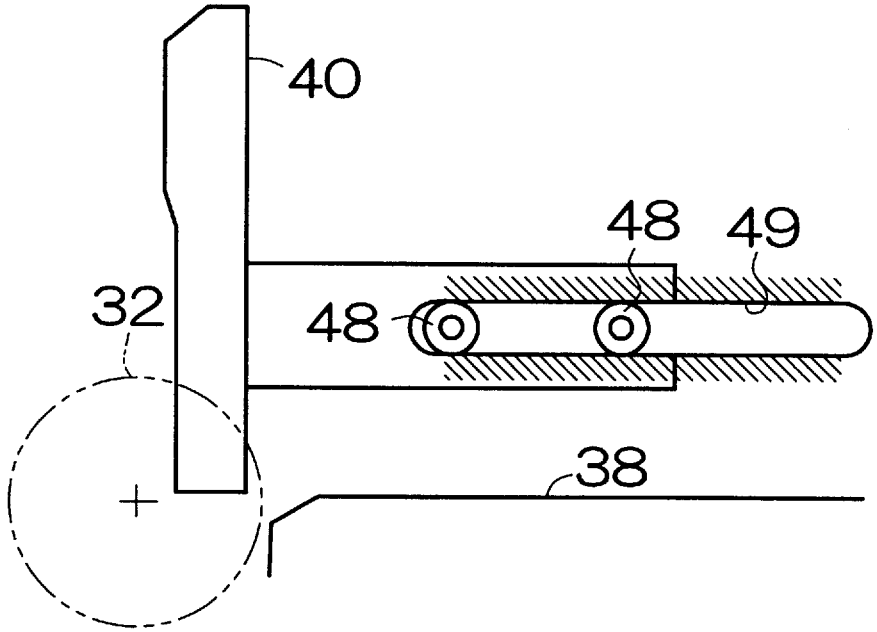
FIG. 5 is a side view of the leaf transfer mechanism unit for schematically illustrating a guide mechanism for movement of a partition unit.
Figure 6:
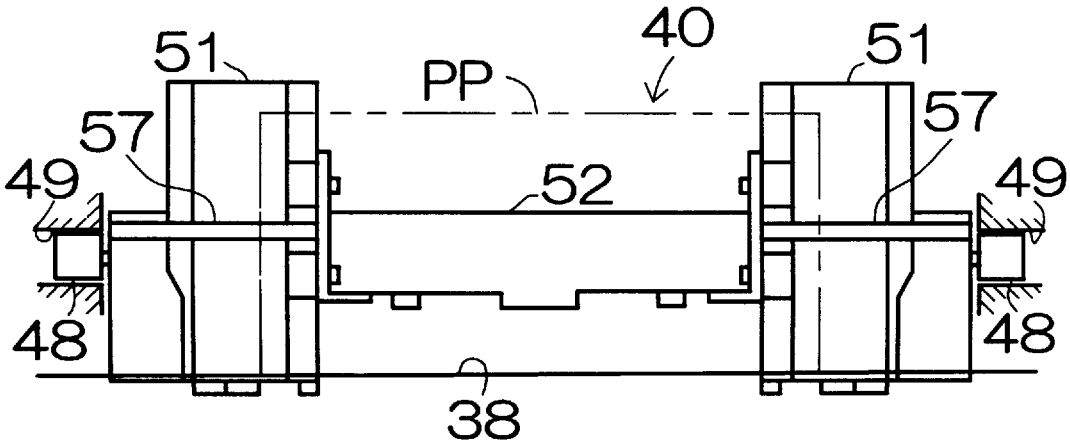
FIG. 6 is a front view schematically illustrating the structure of the partition unit.

As shown in FIG. 5, a guide frame 49 is disposed to extend in the forward and backward direction in parallel with the slide plane 38. The guide frame 49 serves to establish the predetermined path for the sliding movement of the partition unit 40 in combination with a pair of front and rear rollers 48 supported on the partition unit 40 for rotation. The rollers 48 are received and guided in the guide frame 49. The rollers 48 and the guide frame 49 may be arranged on left and right sides of the partition unit 40 in the lateral direction, as shown in FIG. 6. The combination of the rollers 48 and the guide frame 49 serves to allow the partition unit 40 to move forward and backward along the predetermined path keeping the attitude upright to the slide plane 38.

Figure 7:
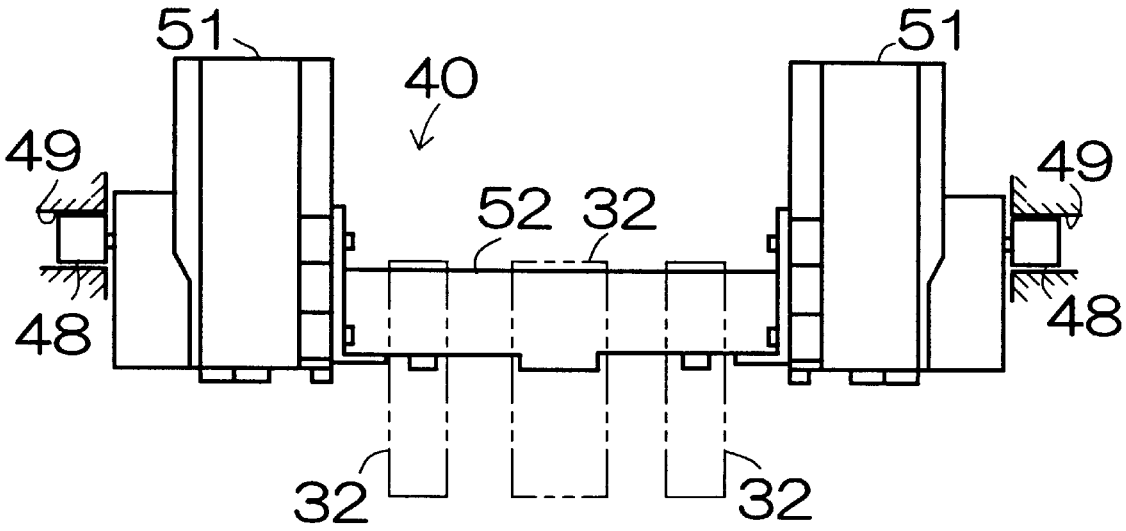
FIG. 7 is a front view of the partition unit for illustrating a reception urging member at a lower limit position.

As shown in FIG. 6, the partition unit 40 includes a pair of upright frames 51 standing upright at left and right sides of the bills PP on or above the slide plane 38. A front or reception urging member 52 is disposed between the upright frames 51. The reception urging member 52 is maintained in an attitude upright to the slide plane 38 in the same manner as the partition unit 40 and the retrieval urging member 42. Moreover, the reception urging member 52 is designed to move between a lower limit position closest to the slide plane 38 and an upper limit position remotest from the slide plane 38. As is apparent from FIG. 7, when the reception urging member 52 is positioned at the lower limit position, the reception urging member 52 is allowed to be opposed to the pickup rollers 32 protruding out of the slide plane 38.

Figure 8:
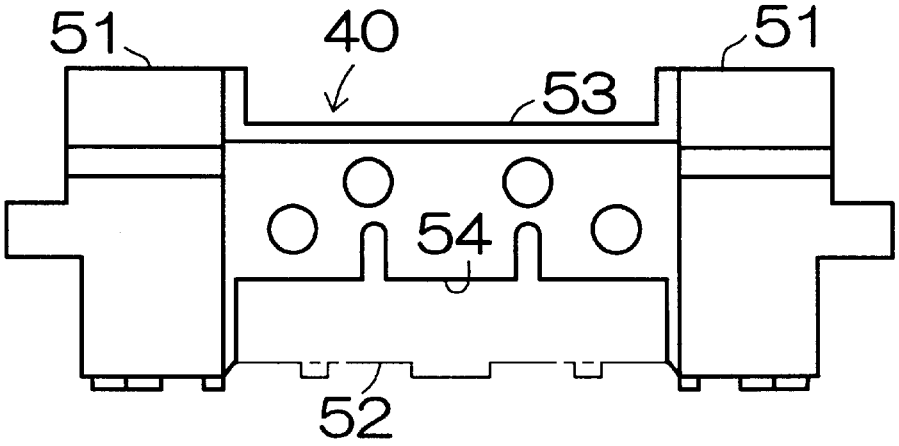
FIG. 8 is a front view of the partition unit for schematically illustrating an intermediate plate.

An intermediate member or plate 53 is employed to rigidly connect the upright frames 51 to each other, as shown in FIG. 8, for example. A recess 54 is defined in the intermediate plate 53 for allowing the pickup rollers 32 protruding out of the slide plane 38 to pass through when the partition unit 40 is caused to move forward to the turnout position 44 (see FIG. 4). The recess 54 serves to avoid collision between the pickup rollers 32 and the intermediate plate 53 during the forward and backward movement of the partition unit 40 along the slide plane 38. The recess 54 can be closed with the reception urging member 52 at the lower limit position.

Figure 9:
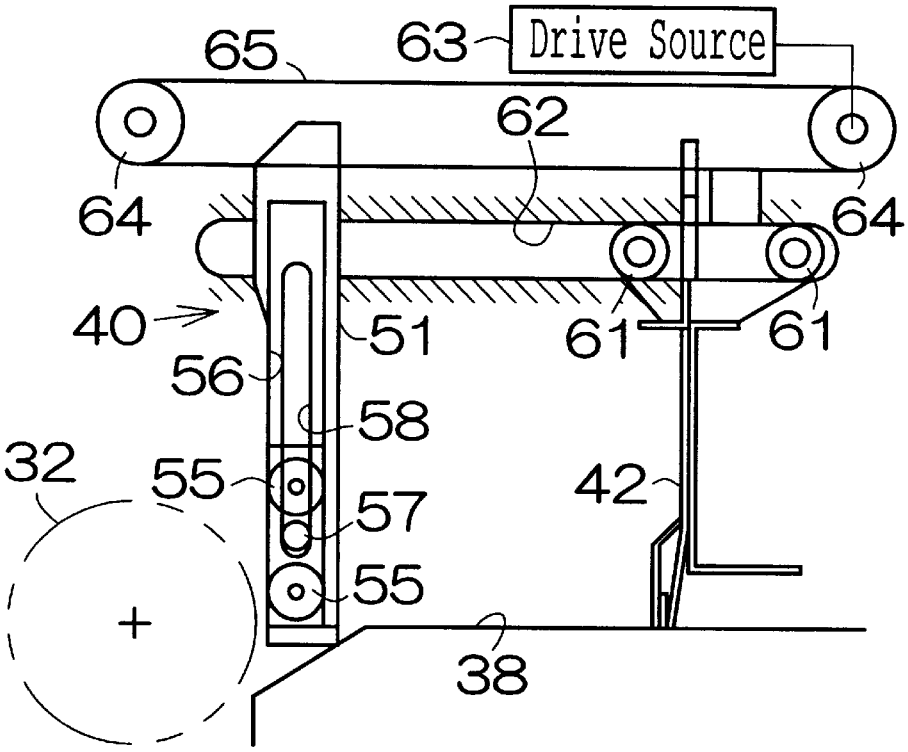
FIG. 9 is a side view of the leaf transfer mechanism unit for illustrating a path for movement of a retrieval urging member.

As shown in FIG. 9, a guide frame 56 is formed in the respective upright frames 52 for defining a guide passage which extends in a direction orthogonal to the slide plane 38. The guide frames 56 are designed to guide the vertical movement of the reception urging member 52 in combination with pairs of upper and lower rollers 55 supported on left and right sides of the reception urging member 52 for rotation.

The reception urging member 52 is provided with a horizontal rod 57 protruding in the horizontal direction from left and right sides of the reception urging member 52, referring to FIGS. 6 and 9. The opposite ends of the horizontal rod 57 are received in slots 58 formed in the upright frames 52, respectively, as is apparent from FIG. 9. The slots 58 are designed to define the upper and lower limit positions of the reception urging member 52 in combination with the horizontal rod 57.

As shown in FIG. 9, a guide frame 62 is also disposed to extend in the forward and backward direction in parallel with the slide plane 38. The guide frame 62 serves to establish a path of movement for the retrieval urging member 42 in combination with a pair of front and rear rollers 61 supported on the retrieval urging member 42 for rotation. The rollers 61 are received and guided in the guide frame 62. The rollers 61 and the guide frame 62 may be arranged on left and right sides of the retrieval urging member 42 in the lateral direction. The combination of the rollers 61 and the guide frame 62 serves to allow the retrieval urging member 42 to move forward and backward along the slide plane 38 keeping the attitude upright to the slide plane 38.

A drive source 63 is designed to control the forward and backward movement of the retrieval urging member 42. The drive source 63 may comprise a servo motor responsive to pulse signals, for example. The driving force from the drive source 63 is transmitted to the retrieval urging member 42 through a transmission belt 65 wound around a pair of front and rear pulleys 64, for example.

Figure 10:
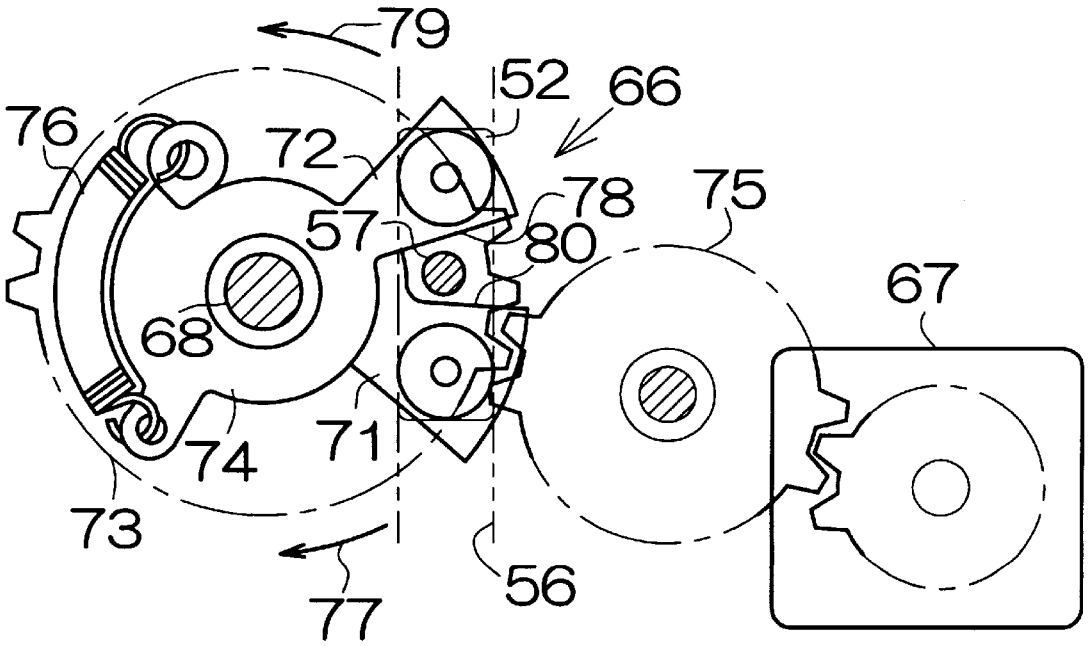
FIG. 10 is an enlarged side view schematically illustrating the structure of a drive mechanism for the reception urging member.

As shown in FIG. 10, a drive source 67 is connected to the reception urging member 52 through a drive mechanism 66. The drive source 67 may comprise a servo motor responsive to pulse signals, for example. The drive source 67 is designed to generate a driving force to be supplied to the reception urging member 52.

The drive mechanism 66 includes a driven piece 71 designed to move forward and backward in a predetermined direction, namely, a rotational direction, around a support axis 68 in parallel with the rotational axis of the pickup rollers 32, and a follower piece 72 likewise designed to move forward and backward in the rotational direction around the support axis 68. The driven piece 71 is integrally formed on a rotor or driven gear 73 rotative around the support axis 68. The follower piece 72 is likewise integrally formed on a rotor 74 rotative around the support axis 68. A relative rotation is allowed between the driven gear 73 and the rotor 74 around the common support axis 68. The driven gear 73 is designed to receive a driving force from the drive source 67 through an intermediate or connecting gear 75.

A biasing member such as a coil spring 76 is interposed between the driven gear 73 and the rotor 74. The coil spring 76 is designed to establish a biasing force for bringing the driven and follower pieces 71, 72 closer to each other along the rotational direction around the support axis 68. When the driven gear 73 is caused to rotate forward in the normal direction 77, the follower piece 72 follows the forward movement of the driven piece 71 so as to rotate forward around the support axis 68 unless the follower piece 72 and/or the rotor 74 receive a resistance or restraint overcoming the biasing force from the coil spring 76.

The aforementioned horizontal rod 57 of the reception urging member 52 is located between the driven and follower pieces 71, 72. When the driven gear 73 is caused to rotate in the normal direction 77 so as to allow the driven piece 71 to move forward around the support axis 68, the follower piece 72 serves to exert a driving force to the horizontal rod 57. The follower piece 72 is designed to define a reception surface 78 for receiving the horizontal rod 57 during the forward movement of the follower piece 72 around the support axis 68. On the other hand, when the driven gear 73 is caused to rotate in the reverse direction 79 so as to allow the driven piece 71 to move backward around the support axis 68, the driven piece 71 serves to exert a driving force to the horizontal rod 57. The driven piece 71 is designed to define an urging surface 80 for urging the horizontal rod 57 against the reception surface 78 of the follower piece 72 during the backward movement of the driven piece 71 around the support axis 68. If the horizontal rod 57 is urged against the reception surface 78 in this manner, the horizontal rod 57 can be maintained connected to the follower piece 72.

Figure 11:
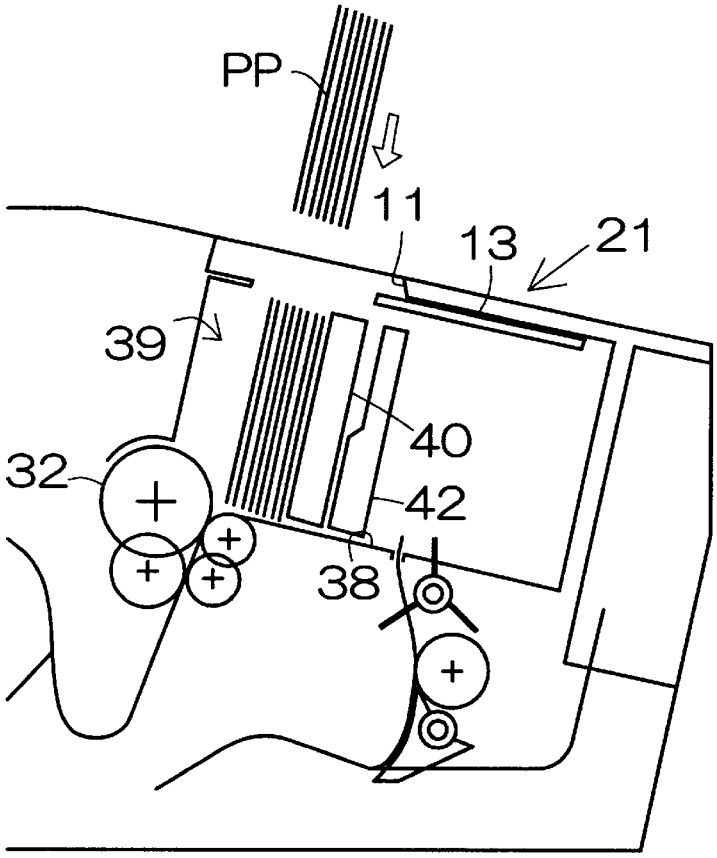
FIG. 11 is a side view illustrating the operation of the leaf transfer mechanism unit when bills are input.
Figure 12:
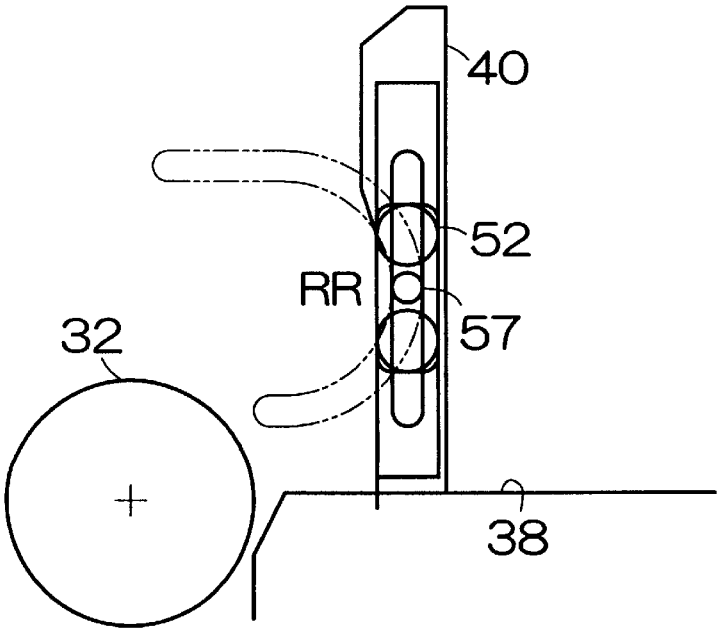
FIG. 12 is a side view of the leaf transfer mechanism unit for illustrating the position of the reception urging member when bills are input.

Next, description will be made on the operation of the aforementioned leaf transfer mechanism unit 21. Assume that a stack of bills PP are thrown into the leaf input opening 11, for example. As shown in FIG. 11, the partition unit 40 has been positioned at the standard position 43 prior to insertion of the bills PP. Accordingly, the leaf reception room 39 is defined between the pickup rollers 32 and the partition unit 40 for receiving the bills PP through the leaf input opening 11. When the cover 13 is opened, a customer is allowed to insert the bills PP, in an upright attitude, into the leaf reception room 39. The slide plane 38 receives the lower ends or edges of the bills PP. The retrieval urging member 42 is expected to stand by right behind the partition unit 40. When the partition unit 40 has been positioned at the standard position 43, the reception urging member 52 incorporated within the partition unit 40 is positioned at the rearmost position RR remotest from the pickup rollers 32, as shown in FIG. 12.

Figure 13:
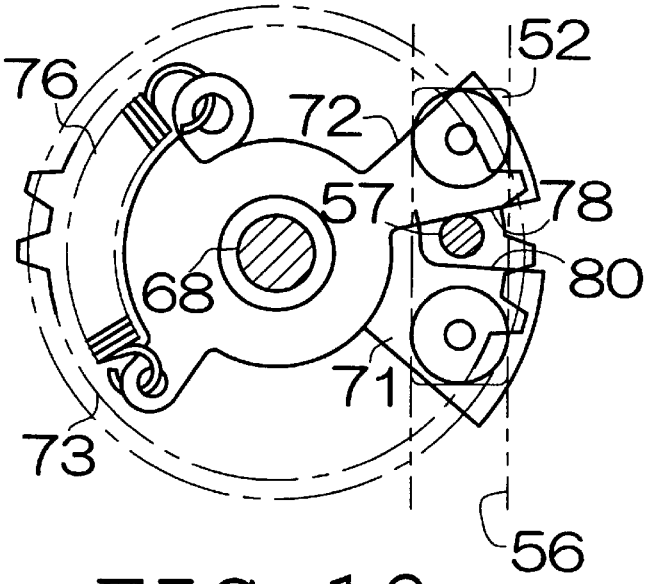
FIG. 13 is an enlarged side view schematically illustrating a driven and a follower piece when bills are input.

Here, the drive source 67 is designed to keep the driven gear 73 at an initial position. When the driven gear 73 is kept at the initial position, the reception urging member 52 is prevented from exerting any restriction to the rotor 74 and the follower piece 72. As a result, the coil spring 76 establishes a biasing force to bring the driven and follower pieces 71, 72 closer to each other around the support axis 68, as shown in FIG. 13. The urging surface 80 of the driven piece 71 serves to urge the horizontal rod 57 of the reception urging member 52 against the reception surface 78 of the follower piece 72. The horizontal rod 57 is kept sandwiched between the driven and follower pieces 71, 72.

Figure 14:
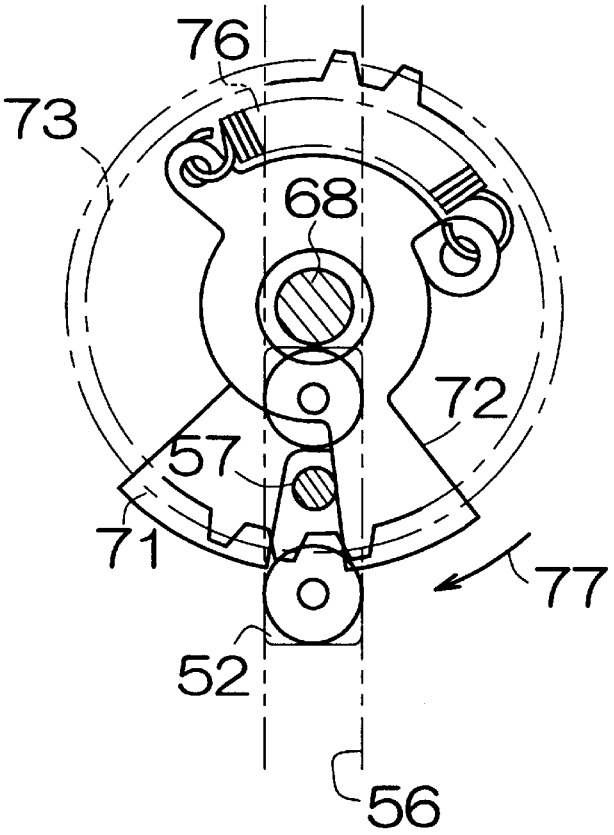
FIG. 14 is an enlarged side view schematically illustrating the driven and follower pieces when bills are transferred.

When the cover 13 is then closed, the drive source 67 serves to rotate the driven gear 73 in the normal direction 77 around the support axis 68. As shown in FIG. 14, the coil spring 76 is designed to cause the follower piece 72 to follow the forward movement of the driven piece 71 around the support axis 68. The follower piece 72 is thus allowed to move forward around the support axis 68. The horizontal rod 57 of the reception urging member 52 receives a driving force from the reception surface 78 of the follower piece 72.

Figure 15:
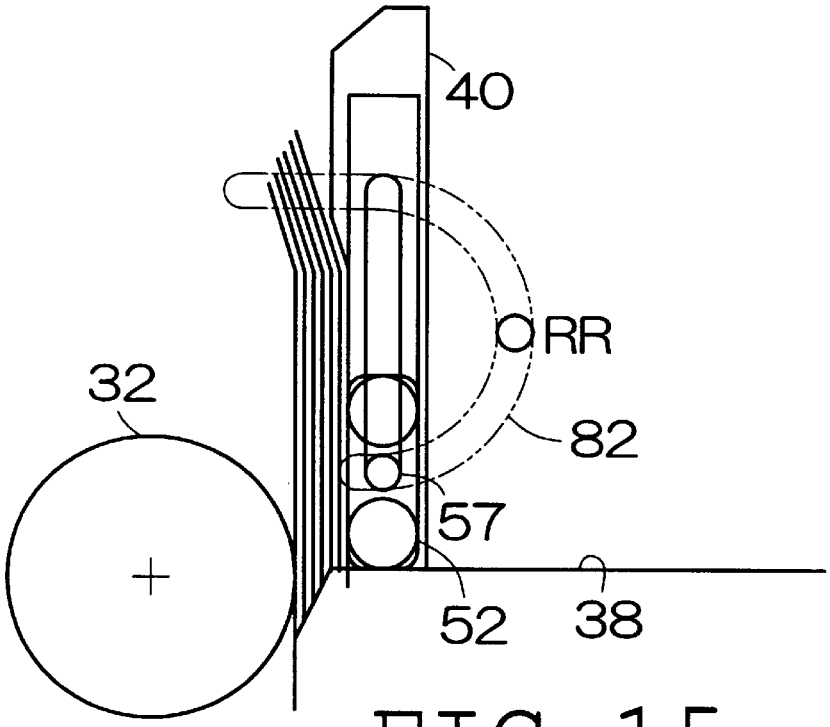
FIG. 15 is a side view of the leaf transfer mechanism unit for illustrating the position of the reception urging member when bills are transferred.

The horizontal rod 57 is allowed to move along a circular orbit around the support axis 68, as shown in FIG. 15. The reception urging member 52 is caused to likewise move along a first advancement path 82, tracing the circular orbit, in response to the movement of the horizontal rod 57. The first advancement path 82 is designed to extend from the rearmost position RR toward the pickup rollers 32 within the limit of a front or collision position allowing the reception urging member 52 to collide against the pickup rollers 32, for example. At the same time, the partition unit 40 incorporating the reception urging member 52 is caused to move forward. A stack of the bills PP is caused to slide toward the pickup rollers 32 along the slide plane 38 in front of the partition unit 40.

Figure 16:
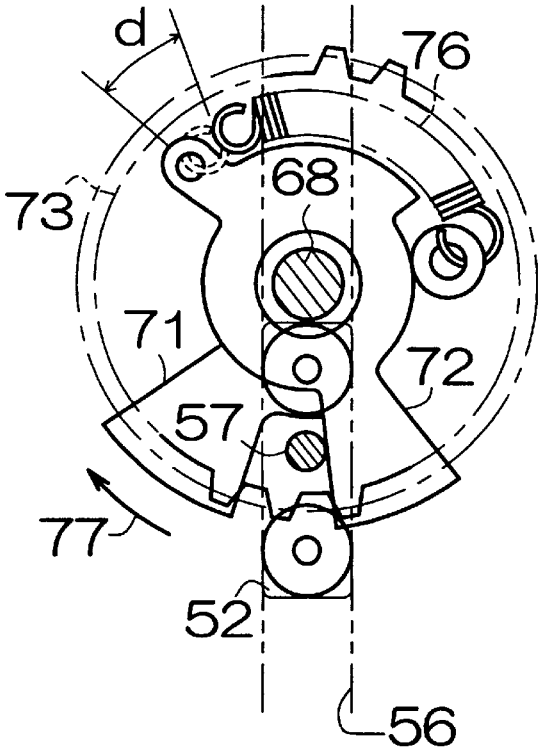
FIG. 16 is an enlarged side view of the driven and follower pieces for illustrating a coil spring stretching when bills are transferred.

When the bills PP contact the pickup rollers 32, the reception urging member 52 is restrained from a further forward movement. As shown in FIG. 16, the drive source 67 allows the driven gear 73 to further rotate in the normal direction 77 around the support axis 68. The rotation of the driven gear 73 induces a further forward movement of the driven piece 71 around the support axis 68. Since a restriction is exerted to the follower piece 72 from the reception urging member 52, the follower piece 72 is prevented from a further forward movement around the support axis 68. The coil spring 76 is caused to stretch by an elongation d corresponding to the amount of rotation of the driven gear 73, namely, the amount of forward movement of the driven piece 71. The elastic force stored in the stretching coil spring 76 is transmitted to the horizontal rod 57 of the reception urging member 52 through the reception surface 78 of the follower piece 72. The bills PP can be urged against the pickup rollers 32 by an urging force corresponding to the elastic force stored in the stretching coil spring 76.

Figure 17:
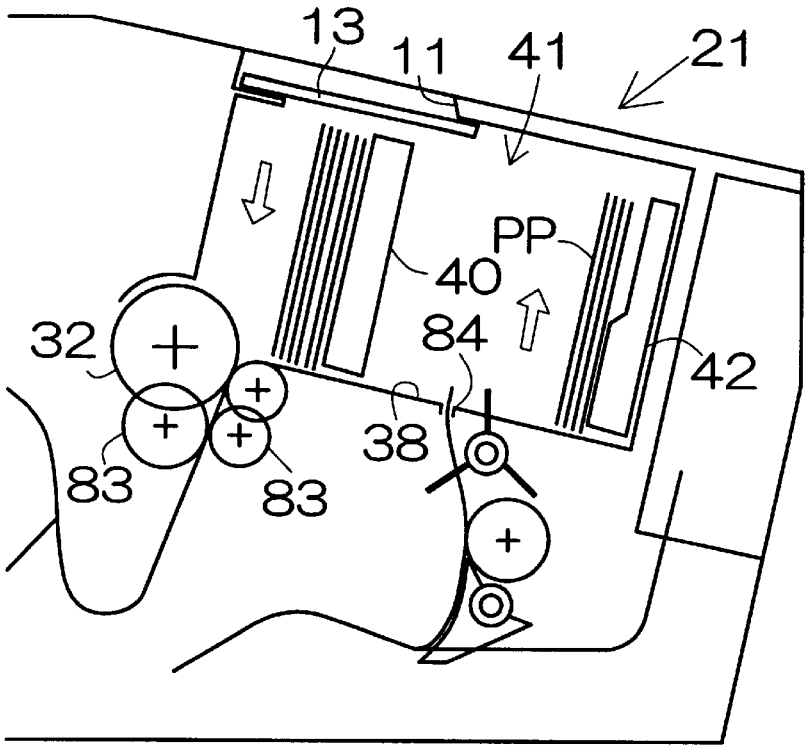
FIG. 17 is a side view illustrating the operation of the leaf transfer mechanism unit when bills are transferred.

The intermittent rotation of the pickup rollers 32 serves to sequentially transfer the bills PP, one by one, to subsequent rollers 83, as shown in FIG. 17. Every time the bill PP is removed between the pickup rollers 32 and the reception urging member 52, the follower piece 72 gradually moves forward around the support axis 68 toward the driven piece 71. The elongation d correspondingly gets decreased in the coil spring 76. The subsequent rollers 83 are then designed to hand the received bills PP over the discrimination section 22.

Prior to the initial operation of the pickup rollers 32, the drive source 63 drives the retrieval urging member 42 for backward movement until the retrieval urging member 42 reaches the rear limit position 45, as shown in FIG. 17. The leaf delivery room 41 is defined behind the partition unit 40 between the retrieval urging member 40 and the partition unit 40. The leaf transfer mechanism unit 21 is thus prepared to receive bills PP, determined unacceptable at the discrimination section 22 in the aforementioned manner. The bills PP to be returned from the discrimination section 22 to the leaf transfer mechanism unit 21 are sequentially discharged into the leaf delivery room 41 through a discharge slot 84 defined in the slide plane 38.

Figure 18:
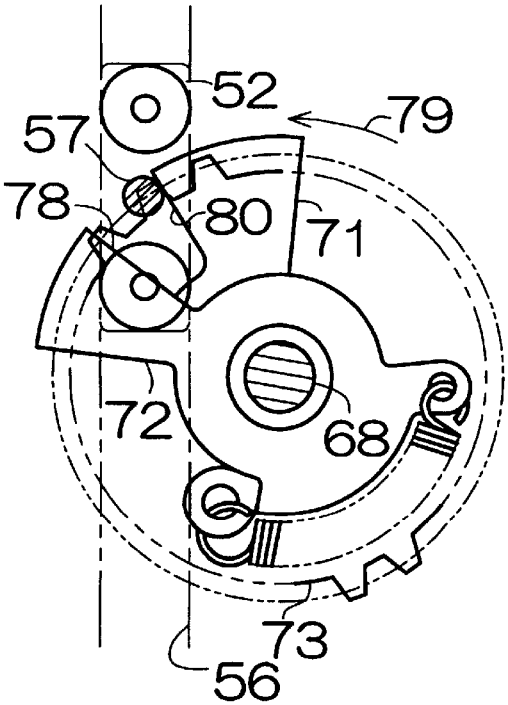
FIG. 18 is an enlarged side view schematically illustrating the driven and follower pieces when bills are dispensed.

Assume that all of the bills PP have been taken out of the leaf reception room 39. If a bill PP is detected in the leaf delivery room 41, the drive source 67 is designed to rotate the driven gear 73 in the reverse direction 79 around the support axis 68, as shown in FIG. 18. The driven piece 71 is caused to move backward around the support axis 68. The horizontal rod 57 can be held on the urging surface 80 of the driven piece 71 during the backward movement of the driven piece 71. Since a driving force from the drive source 67 is rigidly transmitted to the driven piece 71 in this manner, the horizontal rod 57 can precisely be positioned based on the position of the driven piece 71. The urging surface 80 is designed to apply a driving force to the follower piece 72 through the interposed horizontal rod 57. The follower piece 72 is thus allowed to move backward around the support axis 68 along with the driven piece 71.

Figure 19:
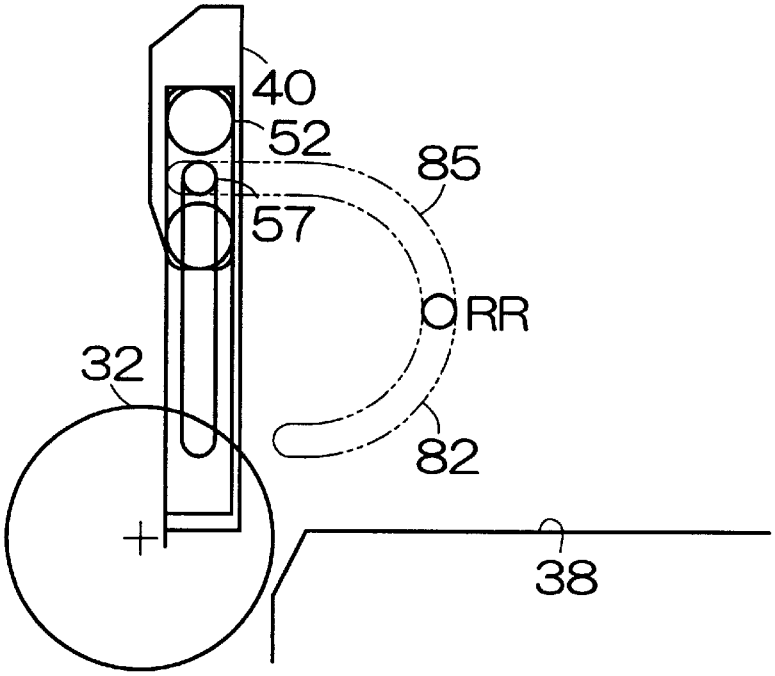
FIG. 19 is a side view of the leaf transfer mechanism unit for illustrating the position of the reception urging member when bills are dispensed.
Figure 20:
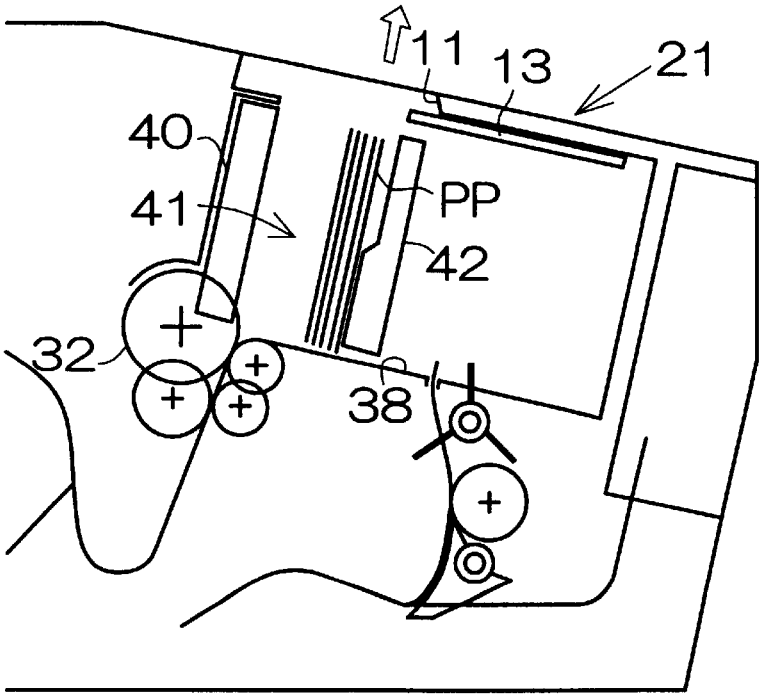
FIG. 20 is a side view illustrating the operation of the leaf transfer mechanism unit when bills are dispensed.

The horizontal rod 57 is allowed to move along a circular orbit around the support axis 68, as shown in FIG. 19. The reception urging member 52 is caused to return to the rearmost position RR along the aforementioned first advancement path 82. The partition unit 40 incorporating the reception urging member 52 is caused to return to the standard position 43. Thereafter, the horizontal rod 57 still keeps moving along a circular orbit around the support axis 68. The reception urging member 52 is introduced into a second advancement path 85. The second advancement path 85 is designed to extend from the rearmost position RR so as to make a roundabout of the pickup rollers 32, for example. The partition unit 40 incorporating the reception urging member 52 is caused to move forward again. The partition unit 40 is caused to pass through the front limit position 46 of the retrieval urging member 42 so as to reach the turnout position 44.

During the forward movement of the partition unit 40, the reception urging member 52 is lifted up so as to open the recess 54 in the partition unit 40. The partition unit 40 and the reception urging member 52 are thus reliably prevented from collision against the pickup rollers 32 during the forward movement of the partition unit 40 along with the incorporated reception urging member 52 to the turnout position 44.

Figure 21:
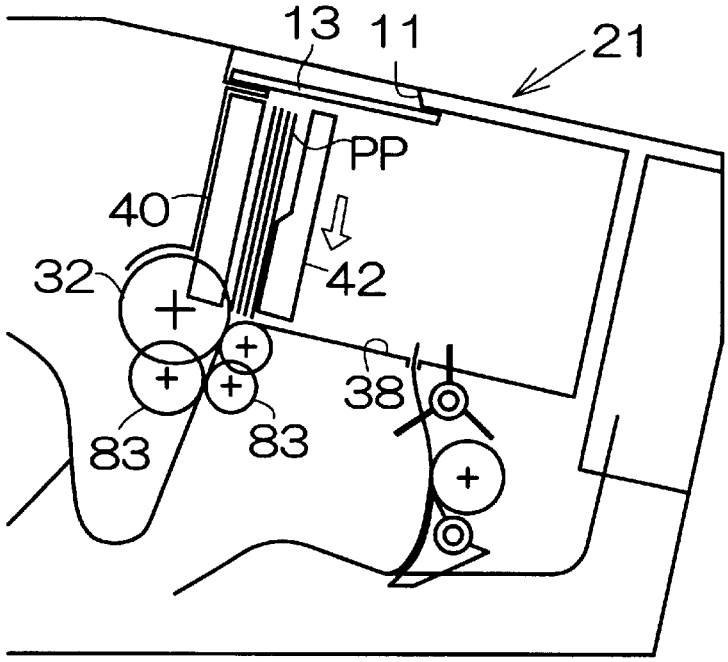
FIG. 21 is a side view illustrating the operation of the leaf transfer mechanism unit when the left bills are transferred.

Assume that the customer carelessly leaves bills PP in the leaf delivery room 41. The drive source 63 is designed to cause a further forward movement of the retrieval urging member 42 toward the pickup rollers 32, as shown in FIG. 21. The retrieval urging member 42 is thus caused to urge the bills PP against the pickup rollers 32. The rotating pickup roller 32 serve to sequentially transfer the bills PP, one by one, to the subsequent rollers 83. Since the partition unit 40 is allowed to reach the turnout position 44 beyond the front limit position 46 of the retrieval urging member 42, the pickup rollers 32 are reliably exposed behind the partition unit 40. The bills PP left in the leaf delivery room 41 can reliably be urged against the pickup rollers 32 by the retrieval urging member 42 behind the partition unit 40.

When cash is to be dispensed, the retrieval urging member 42 is moved backward to the rear limit position 45, while the partition unit 40 is kept at the standard position 43. The leaf delivery room 41 is thus prepared between the partition unit 40 and the retrieval urging member 42 so as to receive bills sequentially discharged from the discharge slot 84. When a set of bills corresponding to the requested amount of money are prepared in the leaf delivery room 41, the partition unit 40 is caused to move forward to the turnout position 44 while the retrieval urging member 42 is allowed to move forward to the position corresponding to the standard position 43 of the partition unit 40 in the same manner as described above. When the cover 13 is opened, a customer is allowed to pick up the bills out of the leaf delivery room 41. If any bill is left in the leaf delivery room 41, the retrieval urging member 42 is allowed to move forward to urge the left bill against the pickup rollers 32 in the same manner as described above. The urged bill can finally be transferred to the subsequent rollers 83.

Figure 22:
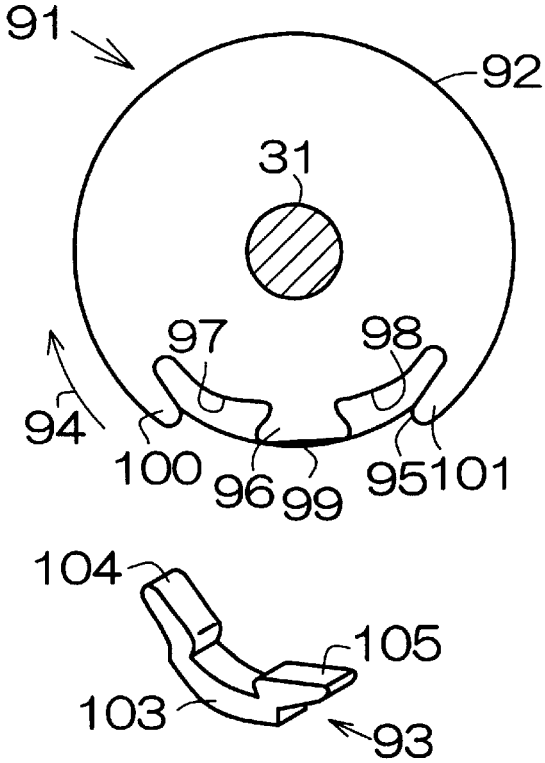
FIG. 22 is an exploded view of the pickup roller.

As shown in FIG. 22, the pickup roller 32 may comprise a cylindrical solid body 91 fixedly supported on the rotation axis 31, and an elastic body 93 detachably mounted in the cylindrical periphery 92 of the cylindrical solid body 91. The pickup roller 32 of the type is designed to utilize the outer peripheral surface of the cylindrical solid body 91 as the slippery surface 34 and the elastic body 93 exposed at the cylindrical periphery 92 of the cylindrical solid body 91 as the friction surface 35. The pickup roller 32 of the type allows a facilitated exchange of the elastic body 93 which suffers from a lower durability as compared with the cylindrical solid body 91. Enough friction can be maintained at the friction surface 35 without exchange of the cylindrical solid body 91 or the entire pickup roller 32. The cylindrical solid body 91 may be made of a rigid synthetic resin member while the elastic body may be made of a rubber or soft synthetic resin member.

As is apparent from FIG. 22, a reception groove 95 is defined in the cylindrical periphery 92 of the cylindrical solid body 91 so as to extend in a circumferential or rotational direction 94. A pedestal 96 is formed to swell from the bottom surface of the reception groove 95. The pedestal 96 is designed to divide the reception groove 95 into a front and a rear groove 97, 98 at front and rear sides of the pedestal 96 in the circumferential direction 94. The pedestal 96 has a shape expanding its top or radial outer end in the circumferential direction 94. The opposite sides of the front and rear grooves 97, 98 in the longitudinal direction of the rotation axis 31 are close with drop prevention walls 99, respectively.

A first restriction piece 100 is connected to the front end of the front groove 97 so as to cover over the front groove 97. The outer surface of the first restriction piece 100 is designed to constitute the cylindrical periphery 92 of the cylindrical solid body 91. An insertion opening still remains between the tip end of the first restriction piece 100 and the pedestal 96. Likewise, a second restriction piece 101 is connected to the rear end of the rear groove 98 so as to cover over the rear groove 98. The outer surface of the second restriction piece 101 is designed to constitute the cylindrical periphery 92 of the cylindrical solid body 91. An insertion opening still remains between the tip end of the second restriction piece 101 and the pedestal 96. The first and second restriction pieces 100, 101 may be formed integrally with the cylindrical solid body 91.

On the other hand, the elastic body 93 comprises an elastic cuticle member 103 designed to constitute the cylindrical periphery 92. A first elastic piece 104 is integrally formed on the inner surface of the elastic cuticle member 103 so as to have a shape corresponding to the front groove 97. Likewise, a second elastic piece 105 is integrally formed on the inner surface of the elastic cuticle member 103 so as to have a shape corresponding to the rear groove 98. Specifically, the elastic cuticle member 103 serves to connect the first and second elastic pieces 104, 105 to each other.

When the elastic body 93 is to be mounted on the cylindrical solid body 91, the first elastic piece 104 is allowed to enter the front groove 97 through the corresponding insertion opening. Likewise, the second elastic piece 105 is allowed to enter the rear groove 98 through the corresponding insertion opening. The elastic deformation of the elastic cuticle member 103 can be utilized to insert the first and second elastic pieces 104, 105 into the corresponding grooves 97, 98. Friction between the first elastic piece 104 and the first restriction piece 100 and between the second elastic piece 105 and the second restriction piece 101 serves to reliably prevent the elastic body 93 from dropping off the cylindrical solid body 91. When the first and second elastic pieces 104, 105 have completely been inserted into the corresponding grooves 97, 98, the elastic cuticle member 103 of the elastic body 93 is allowed to cover over the pedestal 96. The outer surface of the elastic cuticle member 103 thus serves to form the cylindrical periphery 92 continuous from the cylindrical periphery 92 established by the outer surfaces of the first and second restriction pieces 100, 101.

Figure 23:
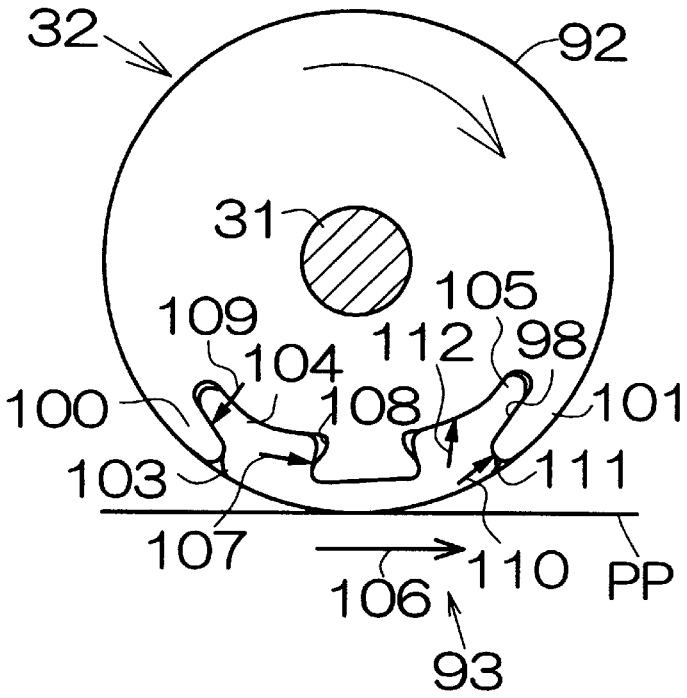
FIG. 23 is a side view schematically illustrating the operation of the pickup roller.
Figure 24:
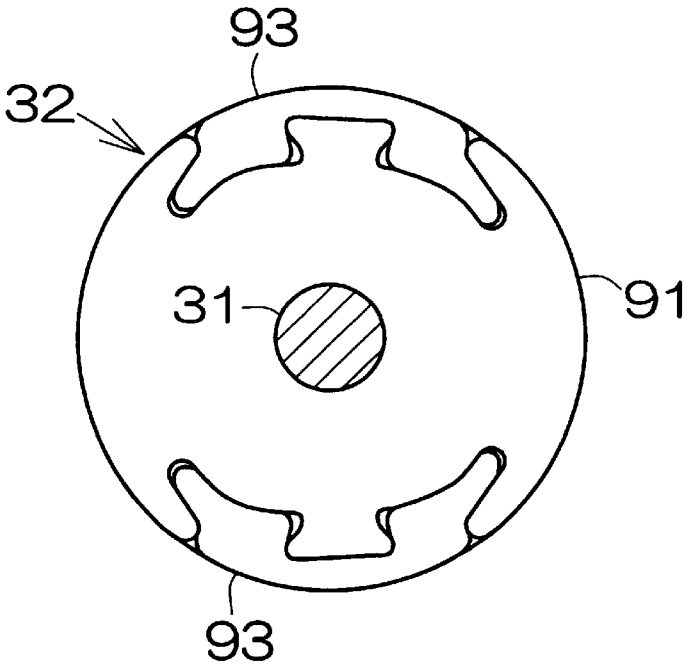
FIG. 24 is a side view illustrating the pickup roller according to another example.

When the rotating pickup roller 32 contacts the surface of a bill PP at the elastic body 93 exposed at the cylindrical periphery 92, for example, a reactive force 106 is exerted on the outer surface of the elastic cuticle member 103 in the rearward direction along the rotational direction, as shown in FIG. 23. A first restriction surface 108 defined on the pedestal 96 is designed to receive movement 107 of the first elastic piece 104 in the rotational direction. The movement 107 may cause a reactive moment 109 in the first elastic piece 104 around the pedestal 96. However, the first restriction piece 100 serves to receive the moment 109, so that the first elastic piece 104 is prevented from dropping out of the front groove 97. The elastic body 93 is thus prevented from dropping off the cylindrical solid body 91.

Under the influence of the reactive force 106, a second restriction surface 111 defined on the tip end of the second restriction piece 101 is designed to receive movement 110 of the elastic cuticle member 103 in the rotational direction. Even when the movement 111 causes a reactive moment 112 in the second elastic piece 105 around the pedestal 96, the rear groove 98 serves to receive the moment 112. The movement 109 of the elastic cuticle member 103 and the second elastic piece 105 can be restrained in this manner, so that the first elastic piece 104 is more reliably prevented from dropping out of the front groove 97. In other words, the elastic body 93 is thus prevented from dropping off the cylindrical solid body 91 more reliably.

In the pickup roller 32, the reception groove 95 and the elastic body 93 are preferably formed into a symmetric shape along the circumferential direction, as is apparent from FIGS. 22 and 23. The symmetric reception groove 95 and the symmetric elastic body 93 may serve to reliably prevent the elastic body 93 from dropping off the cylindrical solid body 91 even when the pickup roller 32 is allowed to rotate in either of opposite directions along the rotational direction.

In addition, the pickup roller 23 may comprise two or more elastic bodies 93 mounted in the single cylindrical solid body 91. For example, when the friction surfaces 35 are defined at two locations on the cylindrical periphery 92 of the cylindrical solid body 91, as shown in FIG. 23, two leaves can sequentially be transferred, one by one, during one rotation of the pickup roller 32. Various parameters such as the number of elastic body 93 as well as the size of the cylindrical solid body 91 and the elastic cuticle member 103 can be determined depending on size of leaves to be transferred by the pickup roller 32.

It should be noted that the drive mechanism 66 may also be employed to transmit a driving force from the drive source 63 to the retrieval urging member 42. In this case, the follower piece 72 may be formed integrally to the pulley 64. The driven gear 73 with the integral driven piece 71 may be allowed to rotate relative to the pulley 64 around the support axis of the pulley 64.

What is claimed is:

1. A leaf transfer mechanism unit comprising:

a pickup roller;

an urging member designed to move forward toward the pickup roller;

a drive source generating a driving force supplied to the urging member;

a driven piece designed to move forward and backward along a predetermined direction in response to the driving force;

a follower piece connected to the urging member and designed to move forward and backward in the predetermined direction;

a biasing member interposed between the driven and follower pieces so as to establish a biasing force for causing the follower piece to follow a forward movement of the driven piece; and a reception surface defined on the follower piece so as to receive a backward movement of the driven piece.

2. The leaf transfer mechanism unit according to claim 1, wherein the driven and follower pieces are integrally formed on a pair of rotors, respectively, allowed for a relative rotation therebetween around a common support axis.

3. The leaf transfer mechanism unit according to claim 1, wherein the pickup roller comprises:

a cylindrical body defining a reception groove extending on an cylindrical periphery in a circumferential direction;

a pedestal swelling from a bottom surface of the reception groove;

a first and a second elastic piece received in the reception groove at front and rear sides of the pedestal, respectively, in the circumferential direction;

an elastic cuticle member covering over the pedestal so as to connect the first and second elastic pieces to each other and designed to constitute the cylindrical periphery of the cylindrical body at an outer surface;

a first restriction piece extending from a position adjacent a front end of the first elastic piece in the circumferential direction so as to cover over the first elastic piece and designed to constitute the cylindrical periphery of the cylindrical body at an outer surface; and a second restriction piece extending from a position adjacent a rear end of the second elastic piece in the circumferential direction so as to cover over the second elastic piece and designed to constitute the cylindrical periphery of the cylindrical body at an outer surface.

4. The leaf transfer mechanism unit according to claim 3, wherein the pickup roller further comprises:

a first restriction surface defined on the pedestal so as to receive movement of the first elastic piece along the circumferential direction; and a second restriction surface defined on the second restriction piece so as to receive movement of the elastic cuticle member along the circumferential direction.

5. The leaf transfer mechanism unit according to claim 1, incorporated in an automatic teller machine.

* * * * *